US009767758B2

(12) United States Patent
Sun et al.

(10) Patent No.: US 9,767,758 B2
(45) Date of Patent: Sep. 19, 2017

(54) DRIVING APPARATUS OF DISPLAY PANEL AND DRIVING METHOD THEREOF, DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Zhihua Sun, Beijing (CN); Seung Min Lee, Beijing (CN); Xingji Wu, Beijing (CN); Jianming Wang, Beijing (CN); Shulin Yao, Beijing (CN); Baoyu Liu, Beijing (CN); Weichao Ma, Beijing (CN)

(73) Assignees: BOE Technology Group Co., Ltd., Beijing (CN); Beijing BOE Display Technology Co., Ltd., Beijing (CN)

( * ) Notice: Subject to any disclaimer, the term of this patent is extended or adjusted under 35 U.S.C. 154(b) by 0 days.

(21) Appl. No.: 14/392,264

(22) PCT Filed: Jun. 15, 2015

(86) PCT No.: PCT/CN2015/081420
§ 371 (c)(1),
(2) Date: Dec. 24, 2015

(87) PCT Pub. No.: WO2016/086639
PCT Pub. Date: Jun. 9, 2016

(65) Prior Publication Data

US 2016/0365056 A1 Dec. 15, 2016

(30) Foreign Application Priority Data

Dec. 2, 2014 (CN) ..... 2014 1 0723215

(51) Int. Cl.
*G09G 3/36* (2006.01)

(52) U.S. Cl.
CPC ..... *G09G 3/3688* (2013.01); *G09G 3/3648* (2013.01); *G09G 3/3677* (2013.01);
(Continued)

(58) Field of Classification Search
None
See application file for complete search history.

(56) References Cited

U.S. PATENT DOCUMENTS 5,248,963 A 9/1993 Yasui et al.
7,864,170 B2 1/2011 Kida et al.
(Continued)

FOREIGN PATENT DOCUMENTS

CN 1547730 A 11/2004
CN 101211036 A 7/2008
(Continued)

OTHER PUBLICATIONS

International Search Report of PCT/CN2015/081420 in Chinese, mailed Sep. 7, 2015 with English translation.
(Continued)

*Primary Examiner* — Kenneth B Lee, Jr.
(74) *Attorney, Agent, or Firm* — Collard & Roe, P.C.

(57) ABSTRACT

There are provided a driving apparatus of a display panel and a driving method thereof, and a display device. The driving apparatus of the display panel comprises a gate driver circuit (101) configured to input a turn-on signal to each gate line on the display panel at a first moment; and a source driver circuit (102) configured to input a first voltage to each data line on the display panel at a first moment, the first voltage being a common electrode voltage of the display panel. The driving apparatus and the driving method, and the display device are capable of raising the effect of eliminating shutdown image sticking.

14 Claims, 4 Drawing Sheets

(52) U.S. Cl.
CPC ..... *G09G 3/3696* (2013.01); *G09G 2300/043* (2013.01); *G09G 2320/0266* (2013.01); *G09G 2330/027* (2013.01)

(56) References Cited

U.S. PATENT DOCUMENTS

| | | | | |
|---|---|---|---|---|
| 2006/0208994 | A1 | 9/2006 | Kuo et al. | |
| 2007/0285363 | A1 | 12/2007 | Do | |
| 2011/0102405 | A1 | 5/2011 | Harada | |
| 2011/0310135 | A1* | 12/2011 | Feng ..... | G09G 3/3648 345/690 |

FOREIGN PATENT DOCUMENTS

| | | | |
|---|---|---|---|
| CN | 101299322 | A | 11/2008 |
| CN | 101494027 | A | 7/2009 |
| CN | 101540149 | A | 9/2009 |
| CN | 101710478 | A | 5/2010 |
| CN | 101882416 | A | 11/2010 |
| CN | 102290032 | A | 12/2011 |
| CN | 102867491 | A | 1/2013 |
| CN | 103065599 | A | 4/2013 |
| CN | 104361866 | A | 2/2015 |
| JP | H 01-170986 | A | 7/1989 |
| JP | H 02-272490 | A | 11/1990 |
| TW | I288389 | B | 10/2007 |

OTHER PUBLICATIONS

Notice of Transmittal of the International Search Report of PCT/CN2015/081420 in Chinese, mailed Sep. 7, 2015.
Written Opinion of the International Searching Authority of PCT/CN2015/081420 in Chinese, mailed Sep. 7, 2015 with English translation.
Chinese Office Action in Chinese Application No. 201410723215.6, mailed Mar. 29, 2016 with English translation.

* cited by examiner

DRIVING APPARATUS OF DISPLAY PANEL AND DRIVING METHOD THEREOF, DISPLAY DEVICE

CROSS REFERENCE TO RELATED APPLICATIONS

This application is the National Stage of PCT/CN2015/081420 filed on Jun. 15, 2015, which claims priority under 35 U.S.C. §119 of Chinese Application No. 201410723215.6 filed on Dec. 2, 2014, the disclosure of which is incorporated by reference.

TECHNICAL FIELD

The present disclosure relates to a driving apparatus of a display panel and a driving method thereof, and a display device.

BACKGROUND

With the development of display technology, people's requirement for display service grows increasingly. At present, a thin film transistor liquid crystal display (TFT-LCD) has occupied a dominated position in the display field due to its advantages of low voltage, small power consumption, large amount of display information, and long service life and so on. However, when TFT-LCD is shut down, the electric field suffered by liquid crystal molecules would exist for a period of time since a driver circuit has a process of discharging slowly. Therefore, a picture displayed finally by TFT-LCD would last a few seconds as the driver circuit discharges. Such phenomenon is called as shutdown image sticking.

In order to solve the problem of shutdown image sticking, when the display is shut down, the gate driver circuit is made to send a turn-on signal to gate lines of all pixel units on a display panel by sending a reset signal to a gate driver circuit after receiving the reset signal. At the same time, when the display is shut down, a source driver circuit connects all output channels to the ground, and thus charges stored in the driver circuit can be released quickly, so that the problem of shutdown image sticking is solved to a certain extent. However, for a display device in a normally white mode, a common electrode voltage (Vcom) of the display panel has not recovered to zero when the display is shut down, while a voltage of a pixel electrode is pulled down to a zero potential quickly. Therefore, the electric field still exists between the common electrode and the pixel electrode, and flash white phenomenon would occur to the display. As a result, it still cannot achieve a good effect of eliminating the shutdown image sticking.

SUMMARY

There are provided in embodiments of the present disclosure a driving apparatus of a display panel and a driving method thereof, and a display device, which are capable of raising the effect of eliminating shutdown image sticking.

According to one aspect of the present disclosure, there is provided a driving apparatus of a display panel, comprising a gate driver circuit and a source driver circuit;

the gate driver circuit is configured to input a turn-on signal to each gate line on the display panel at a first moment; and the source driver circuit is configured to input a first voltage to each data line on the display panel at a first moment, the first voltage being a common electrode voltage of the display panel.

Alternatively, the driving apparatus of the display panel further comprises a reset circuit and a power supply circuit;

the reset circuit is configured to detect a power supply voltage outputted by the power supply circuit, and output a first control signal to the gate driver circuit when the power supply voltage reaches a first preset voltage value; the gate driver circuit is specifically configured to receive the first control signal, and input the turn-on signal to each gate line on the display panel based on the first control signal; wherein the first moment is a moment when the power supply voltage reaches the first preset voltage value.

Alternatively, the source driver circuit is specifically configured to detect the power supply voltage outputted by the power supply circuit, and input the first voltage to each data line on the display panel when the power supply voltage reaches the first preset voltage value.

Alternatively, the source driver circuit is connected to a common electrode.

Alternatively, the first preset voltage value is 60%-80% of a maximum value of the power supply voltage outputted by the power supply circuit.

Alternatively, the first voltage value is a grounding voltage value.

According to another aspect of the present disclosure, there is provided a driving method of a display panel, comprising:

inputting a turn-on signal to each gate line on the display panel at a first moment; and inputting a first voltage to each data line on the display panel at the first moment, the first voltage being a common electrode voltage of the display panel.

Alternatively, the driving method of the display panel further comprises:

detecting a power supply voltage, and generating a first control signal when the power supply voltage reaches a first preset voltage value; and inputting the turn-on signal to each gate line on the display panel based on the first control signal; wherein the first moment is a moment when the power supply voltage reaches the first preset voltage value.

Alternatively, the power supply voltage is detected, and the first voltage is inputted to each data line on the display panel when the power supply voltage reaches the first preset voltage value.

Alternatively, the first preset voltage value is 60%-80% of a maximum value of the power supply voltage.

Alternatively, the first voltage value is a grounding voltage value.

According to another aspect of the present disclosure, there is provided a display device, comprising a display panel, and further comprising the driving apparatus of the display panel described above.

The driving apparatus of the display panel and the driving method thereof, and the display device provided in the embodiments of the present disclosure input the turn-on signal to each gate line on the display panel at the first moment, and inputs the common electrode voltage to each data line on the display panel. At this time, a voltage difference between the common electrode and the pixel electrode is reset as zero, and charges stored in the pixel unit can be released quickly, so that the effect of eliminating shutdown image sticking can be raised.

DETAILED DESCRIPTION

In order to describe technical solutions in embodiments of the present disclosure more clearly, a plurality of embodiments will be described below by referring to figures, wherein the same reference mark is used to represent the same element in the disclosure. In the description below, for the purpose of explaining, some specific details are given, so as to provide comprehensive understanding of one or more embodiments. However, it is obvious that these specific details may not be used to implement the embodiments.

Figure 1:
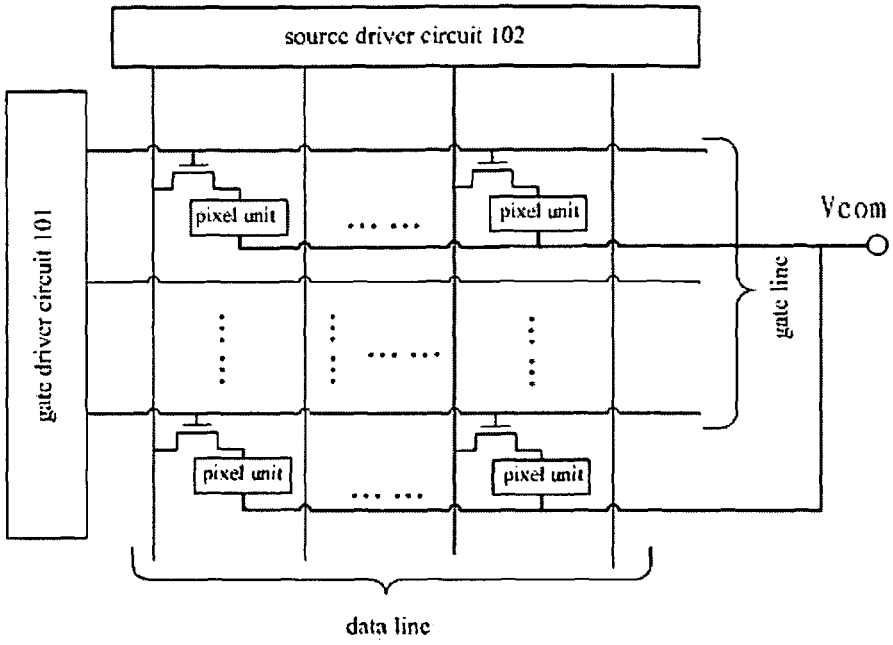
FIG. 1 is a schematic diagram of a configuration of a driving apparatus of display panel provided in an embodiment of the present disclosure.

FIG. 1 shows a schematic diagram of a configuration of a driving apparatus of a display panel provided in an embodiment of the present disclosure. As shown in FIG. 1, the driving apparatus of the display panel comprises: a gate driver circuit 101 and a source driver circuit 102. The gate driver circuit 101 is configured to input a turn-on signal to each gate line on the display panel at a first moment. The source driver circuit 102 is configured to input a first voltage to each data line on the display panel at the first moment. The first voltage is a common electrode voltage of the display panel.

In FIG. 1, the driving apparatus of the display panel can adopt a progressive scanning manner to drive the display panel. Each pixel unit in the display panel can be connected to the gate line of the display panel and the data line of the display panel through a thin film transistor (TFT). Specifically, a source of TFT is connected to the data line of the display panel, a gate thereof is connected to the gate line of the display panel, and a drain thereof is connected to a pixel electrode of the display panel. In addition, the gate line of the display panel is connected to the gate driver circuit, and the data line of the display panel is connected to the source driver circuit. A data line voltage is provided to the pixel electrode by connecting the drain of TFT to the pixel electrode, and a common electrode voltage is provided to the common electrode by connecting a voltage Vcom to the common electrode. When the gate driver circuit 101 inputs the turn-on signal to each gate line on the display panel at the first moment, the display panel can turn on switch devices in pixel units of a row corresponding to each gate line according to the turn-on signal, so that the data line voltage is provide to the pixel electrode of the pixel unit through the turned on switch devices. In the embodiments of the present disclosure, the first moment can be a moment after the display is shut down. The source driver circuit 102 inputs the common electrode voltage to each data line on the display panel at the first moment, so that a potential difference between the pixel electrode voltage and the common electrode voltage is zero, and the pixel recovers to an initial status. Specifically, the source driver circuit 102 is connected to the common electrode to obtain the common electrode voltage of the common electrode and to provide the common electrode voltage to each data line at the first moment. Exemplarily, the source driver circuit 102 of the display panel can be connected to the common electrode through a source chip on flex (COF).

The driving apparatus of the display panel provided in the embodiment of the present disclosure inputs the turn-on signal to each gate line on the display panel at the first moment, and inputs the common electrode voltage to each data line on the display panel. At this time, the voltage difference between the common electrode and the pixel electrode is reset as zero, and charges stored in the pixel units can be released quickly, so that the effect of eliminating the shutdown image sticking can be raised.

Figure 2:
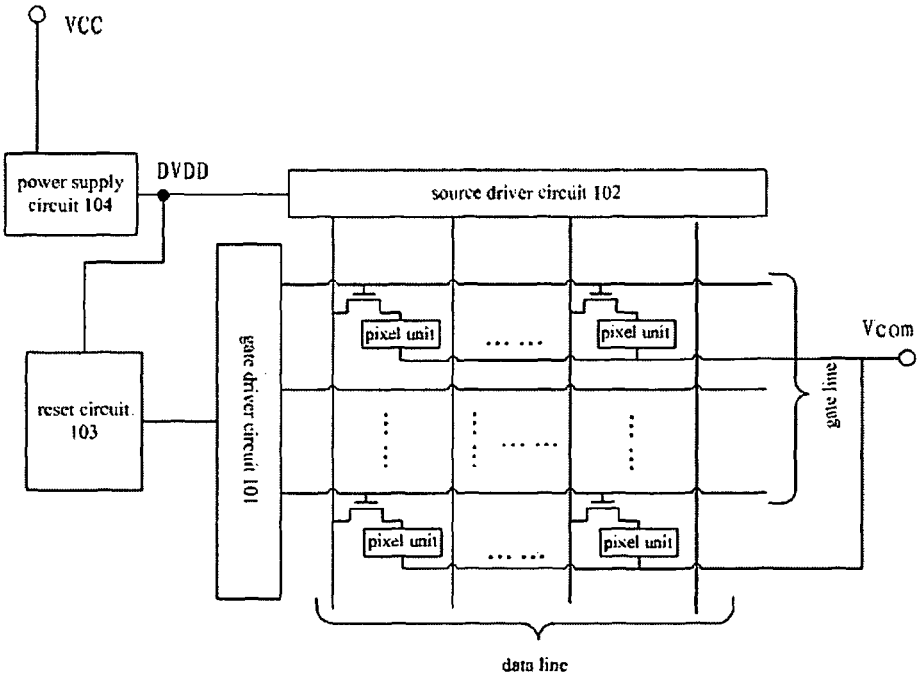
FIG. 2 is a schematic diagram of a configuration of a driving apparatus of a display panel provided in another embodiment of the present disclosure.

FIG. 2 shows a schematic diagram of a configuration of a driving apparatus of a display panel provided in another embodiment of the present disclosure. As shown in FIG. 2, the driving apparatus of the display provided in the embodiment of the present disclosure further comprises a reset circuit 103 and a power supply circuit 104. The reset circuit 103 is configured to detect a power supply voltage outputted by the power supply circuit 104. When the power supply voltage reaches a first preset voltage value, a first control signal is outputted to the gate driver circuit 101. The gate driver circuit 101 can be configured to receive the first control signal, and input a turn-on signal to each gate line on the display panel according to the first control signal. Herein, the first moment is a moment when the power supply voltage reaches the first preset voltage value.

In the circuit as shown in FIG. 2, the source driver circuit 102 can be configured to detect the power supply voltage outputted by the power supply circuit 104. When the power supply voltage reaches the first preset voltage value, a first voltage is inputted to each data line on the display panel.

Alternatively, the first preset voltage can be 60%-80% of a maximum value of the power supply voltage outputted by the power supply circuit.

Figure 3:
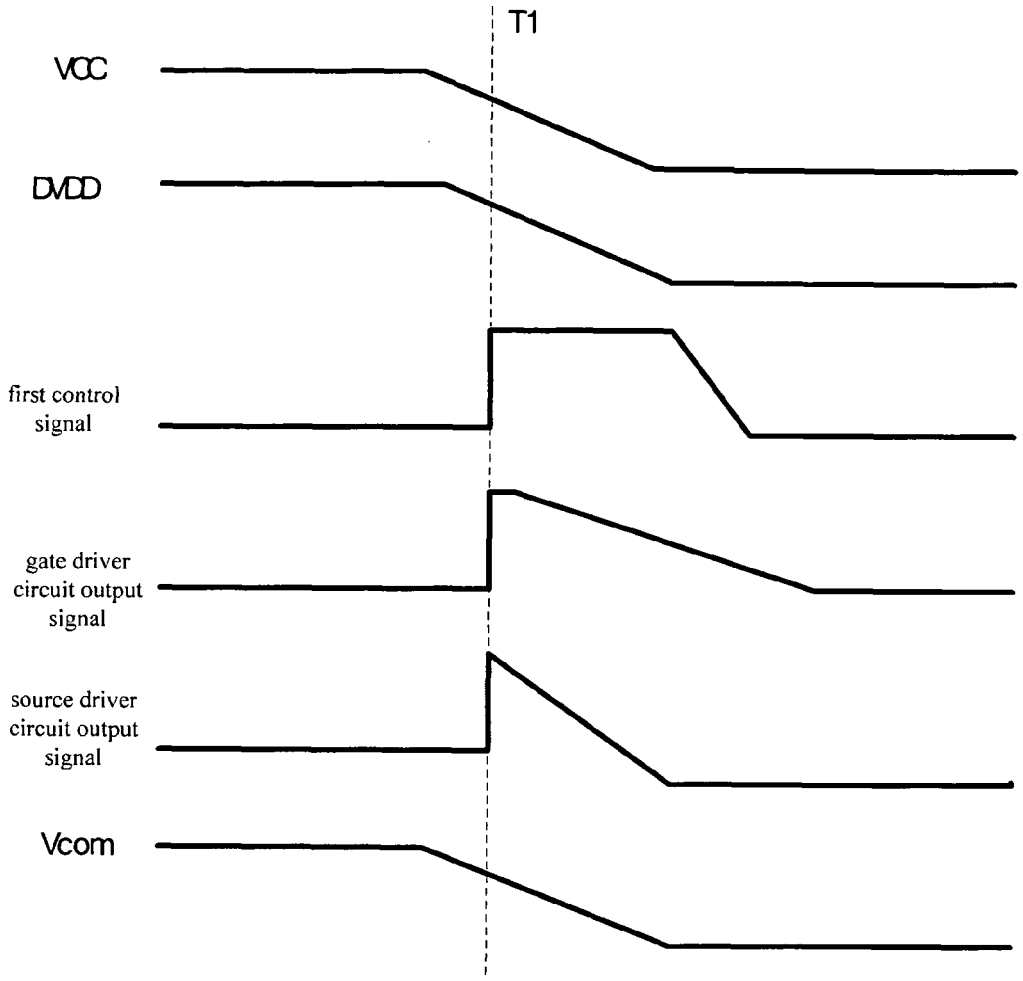
FIG. 3 is a schematic diagram of a circuit signal timing status provided in an embodiment of the present disclosure.

FIG. 3 shows a schematic diagram of a circuit signal timing status provided in an embodiment of the present disclosure. As shown in the circuit signal timing status as shown in FIG. 3, timing statuses of a power supply voltage VCC, a power supply voltage DVDD outputted by a power supply circuit, a first control signal RESET, a gate driver circuit output signal Gate output, a source driver circuit output signal Date output and a common electrode voltage Vcom. When the display is shut down, as the common power supply voltage VCC reduces, the power supply voltage DVDD outputted by the power supply circuit 104 and the common electrode voltage Vcom would also reduce gradually. Exemplarily, the power supply circuit can perform conversion from alternating current into direct current on the power supply voltage VCC or perform conversion of voltage amplitude, so a to obtain the power supply voltage DVDD. When a voltage value of the power supply voltage DVDD reduces to 75% of a maximum vale of the power supply voltage DVDD, i.e., at T1 as shown in FIG. 3, the reset circuit 103 is triggered to send a first control signal, and at this time, the first control signal can be at a high level, and the gate driver circuit 101 is triggered to input the turn-on signal to each gate line on the display panel. Of course, according to a type of TFT in the pixel circuit, it can be known that the turn-on signal may be at the high level when TFT is an N type transistor, and at the same time, the source driver circuit 102 inputs a first voltage to each data line, and the first voltage is a common electrode voltage. Now, the data line voltage varies with the common electrode voltage synchronously, which ensures that a potential difference between the common electrode and the pixel electrode in the pixel unit after the display is shut down is zero. The above is just described by taking the voltage value of the power supply voltage DVDD reducing to 75% of the maximum value of the power supply voltage DVDD as a example, and other reference values within a range from 60% to 80% can also be set.

Alternatively, the first voltage value can be a grounding voltage value.

In the liquid crystal display panel, a deflecting voltage of the liquid crystal molecules is used to control the display panel to display various different grey scales, and the deflecting voltage of the liquid crystal molecules is determined by the difference of the pixel electrode voltage and the common electrode voltage. In some display panels, the common electrode voltage is a constant value, and its common electrode voltage mostly adopts the grounding voltage value. However, in some other display panels, the common electrode voltage can be adjusted and changed. For a display panel whose common electrode voltage is a constant grounding voltage value, the source driver circuit inputs the common electrode voltage of the display panel to each data line at the first moment, that is, the first voltage value is a grounding voltage value. At this time, the potential difference of the pixel electrode voltage and the common electrode voltage is zero, and the deflecting potential suffered by the liquid crystal molecules is zero. For a display panel whose common electrode voltage is adjusted and changed, the source driver circuit inputs the common electrode voltage of the display panel to each data line at the first moment, and the common electrode voltage in this kind of display panel may not be the grounding voltage value.

The driving apparatus of the display panel provided in the embodiment of the present disclosure inputs the turn-on signal to each gate line on the display panel at the first moment, and inputs the common electrode voltage to each data line on the display panel. At this time, a voltage difference between the common electrode and the pixel electrode is reset as zero, and charges stored in the pixel units can be released quickly, so that the effect of eliminating the shutdown image sticking can be raised.

Figure 4:
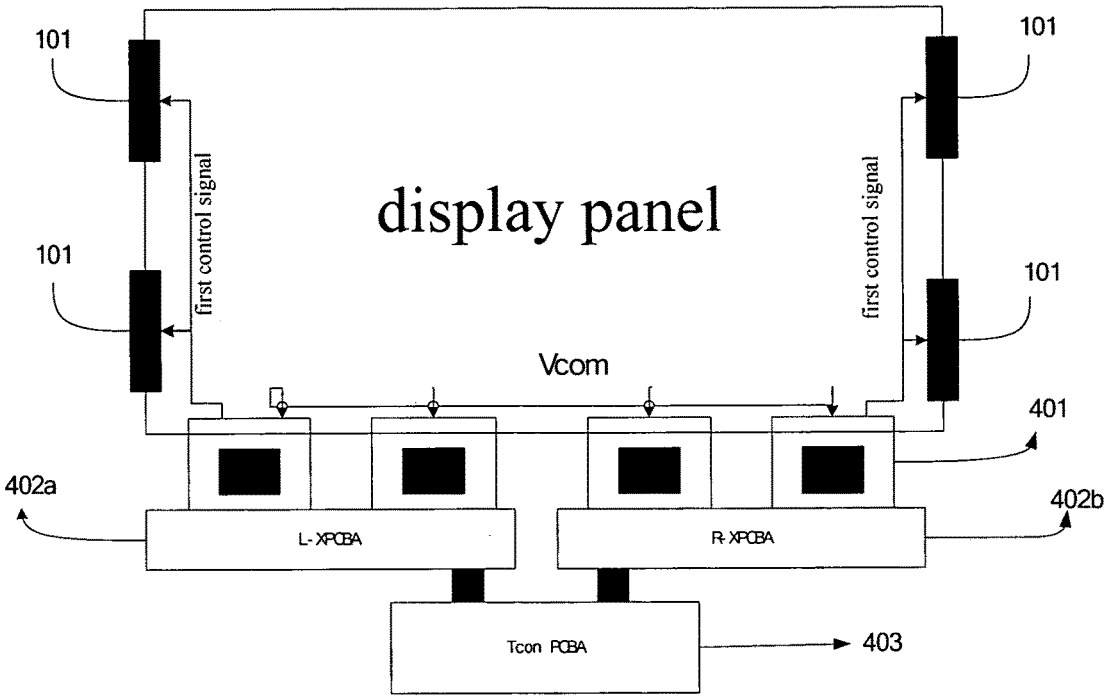
FIG. 4 is a schematic diagram of a configuration of a display panel provided in an embodiment of the present disclosure.

FIG. 4 shows a schematic diagram of a display panel provided in an embodiment of the present disclosure. The driving apparatus of the display panel provided in the embodiment of the present disclosure is applicable to a large-size display panel. As shown in FIG. 4, in FIG. 4, a reference mark 101 represents a gate driver circuit configured to input a gate driver signal to a gate line on the display panel. Since the gate driver circuit comprises generally a TFT device and a capacitor device only, the gate driver circuit can be integrated around the display panel through a manufacturing process of the display panel, so as to realize narrow frame of the display device; a reference mark 401 represents a chip on flex (COF) and configured to connect a printed circuit board assembly (PCBA) to the display panel. A plurality of connection channels are comprised in the chip on flex 401, and can be configured to connect to the data line and the source driver circuit 102 and connect to the reset circuit 103 and the gate driver circuit 101, and further can be configured to connect to the source driver circuit 102 and the common electrode. In a large-size display panel, the display panel provides the data line voltage to the display panel by at least two source driver circuits, and provides the gate line signal by at least two gate driver circuits. Specifically, in the circuit as shown in FIG. 4, the printed circuit board assembly 402 comprises two printed circuit board assemblies 402*a* (L-XPCBA) and 402*b* (R-XPCBA). The printed circuit board assemblies 402*a* (L-XPCBA) and 402*b* (R-XPCBA) are configured to provide respectively the data line voltages to a display area on a left side of the display panel and a display area on a right side of the display panel. Herein, both the printed circuit board assemblies 402*a* (L-XPCBA) and 402*b* (R-XPCBA) comprise the source driver circuit 102 and the reset circuit 103, wherein the source driver circuit 102 is configured to output the data line voltage to the display panel, and the reset circuit 103 is configured to output the first control signal to the gate driver circuit 101. In addition, FIG. 4 shows a timer control register PCBA 403 (referred as Tcon for short) configured to provide a benchmark reference timing to the printed circuit board assemblies 402*a* (L-XPCBA) and 402*b* (R-XPCBA). In general, in the large-size display panel, and the charges of the pixel electrode is neutralize by the manner of shorting all the data lines to eliminate the phenomenon of shutdown image sticking. However, since the discharging rate of the pixel electrode controlled by each source driver circuit is not the same, bright lines would still occur at a junction of the display area controlled by each source driver circuit when the display is shut down. Therefore, in the embodiment of the present disclosure, the Vcom voltage is input to each data line on the display panel at a predetermined moment after the display is shut down, so that the voltage difference between the common electrode and the pixel electrode is reset as zero and the charges stored in the pixel unit can be released quickly, so that the appearance of bright lines at the junction of the display area is avoided, and thus the effect of eliminating the shutdown image sticking can be raised.

Figure 5:
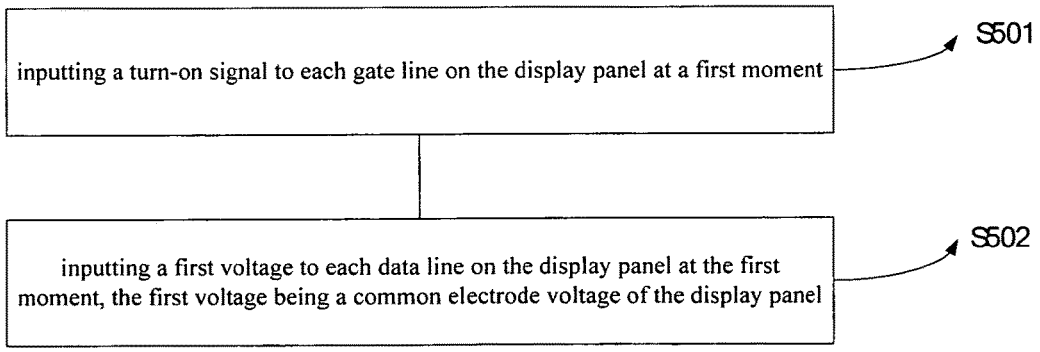
FIG. 5 is a schematic flow diagram of a driving method of a display panel provided in an embodiment of the present disclosure.

FIG. 5 shows a schematic flow diagram of a driving method of a display panel provided in an embodiment of the present disclosure. As shown in FIG. 5, the driving method of the display panel provided in the embodiment of the present disclosure comprises following operation processes:

in step S501, inputting a turn-on signal to each gate line on the display panel at a first moment; and in step S502, inputting a first voltage to each data line on the display panel at the first moment, the first voltage being a common electrode voltage of the display panel.

The driving method of the display panel provided in the embodiment of the present disclosure inputs the turn-on signal to each gate line on the display panel at the first moment, and inputs the common electrode voltage to each data line on the display panel. At this time, a voltage difference between the common electrode and the pixel electrode is reset as zero, and charges stored in the pixel units can be released quickly, so that the effect of eliminating the shutdown image sticking can be raised.

Figure 6:
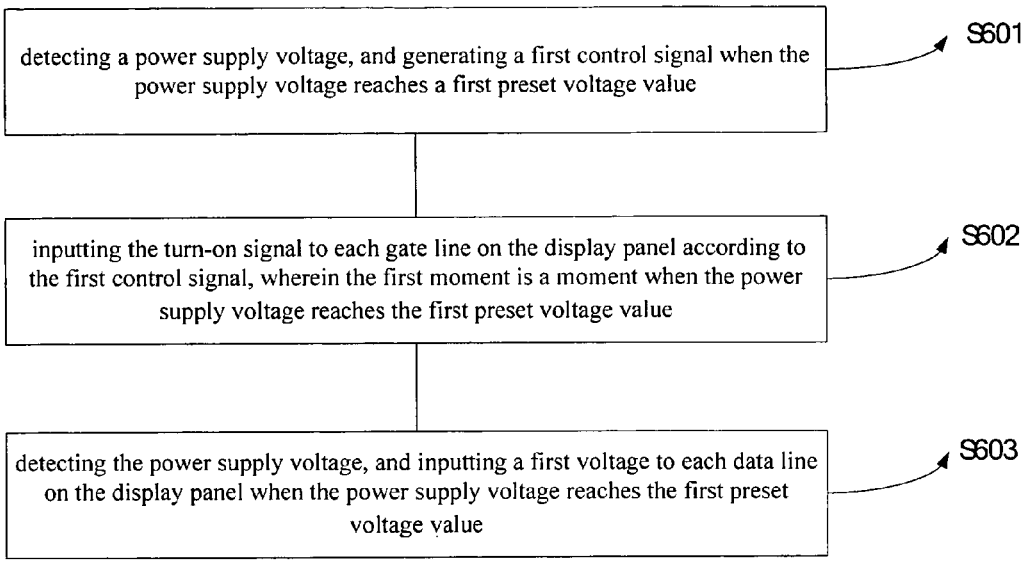
FIG. 6 is a schematic flow diagram of a driving method of a display panel provided in another embodiment of the present disclosure.

FIG. 6 shows a schematic flow diagram of a driving method of a display panel provided in another embodiment of the present disclosure. As shown in FIG. 6, the driving method of the display panel provided in the embodiment comprises following steps:

In step S601, a power supply voltage is detected, and a first control signal is generated when the power supply voltage reaches a first preset voltage value.

Alternatively, the first preset voltage value is 60%-80% of a maximum value of the power supply voltage. An exemplary way is that in step S401, the first control signal is generated when it is detected that the power supply voltage reduces to 75% of the maximum of the power supply voltage after the display is shut down.

In step S602, the turn-on signal is inputted to each gate line on the display panel according to the first control signal, wherein the first moment is a moment when the power supply voltage reaches the first preset voltage value.

In step S603, the power supply voltage is detected, and a first voltage is inputted to each data line on the display panel when the power supply voltage reaches the first preset voltage value.

It needs to note that in the method flow as shown in FIG. 6, there is no sequential order when steps S601 and S603 are performed, that is, either step S601 or step S603 can be performed firstly, and steps S601 and S603 can be performed simultaneously.

Alternatively, the first voltage value is a grounding voltage value.

The driving method of the display panel provided in the embodiment of the present disclosure inputs the turn-on signal to each gate line on the display panel at the first moment, and inputs the common electrode voltage to each data line on the display panel. At this time, a voltage difference between the common electrode and the pixel electrode is reset as zero, and charges stored in the pixel units can be released quickly, so that the effect of eliminating the shutdown image sticking can be raised.

There is provided in an embodiment of the present disclosure a display device, comprising a display panel and further comprising any of the driving apparatus of the display panel described above. The display device can be a display device such an electronic paper, a mobile phone, a television, a digital photo frame and so on.

The display device provided in the embodiment of the present disclosure inputs the turn-on signal to each gate line on the display panel at the first moment, and inputs the common electrode voltage to each data line on the display panel. At this time, a voltage difference between the common electrode and the pixel electrode is reset as zero, and charges stored in the pixel units can be released quickly, so that the effect of eliminating the shutdown image sticking can be raised.

In the several embodiments provided in the present disclosure, it should be understood that the described method, apparatus and device can be implemented in other ways. For example, the apparatus embodiment described above is just for illustration. The division of the units is just a logically functional division, and there may be other dividing manners in the actual implementation. For example, a plurality of units or components can be combined or integrated into another device, or some features may be omitted, or may not be performed.

The above descriptions are just specific implementations of the present disclosure. However, the protection scope of the present disclosure is not limited thereto, and any alternation or replacement that can be easily conceived by those skilled in the art who are familiar with the technical field within the technical scope of the present disclosure shall be deemed as falling into the protection scope of the present disclosure. Therefore, the protection scope of the present disclosure shall be subjected to the protection scope of the claims.

The present application claims the priority of a Chinese patent application No. 201410723215.6 filed on Dec. 2, 2014. Herein, the content disclosed by the Chinese patent application is incorporated in full by reference as a part of the present disclosure.

What is claimed is:

1. A driving apparatus of a display panel, comprising a gate driver circuit configured to input a turn-on signal to each gate line on the display panel at a first moment; and a source driver circuit configured to input a first voltage to each data line on the display panel at the first moment, the first voltage being a common electrode voltage of the display panel, the driving apparatus of the display panel further comprising a reset circuit and a power supply circuit, wherein the reset circuit is configured to detect a power supply voltage outputted by the power supply circuit, and output a first control signal to the gate driver circuit when the power supply voltage reaches a first preset voltage value; and wherein the source driver circuit is configured to detect the power supply voltage outputted by the power supply circuit, and input the first voltage to each data line on the display panel when the power supply voltage reaches the first preset voltage value.

2. The driving apparatus according to claim 1, wherein the gate driver circuit is configured to receive the first control signal, and input the turn-on signal to each gate line on the display panel based on the first control signal, the first moment being a moment when the power supply voltage reaches the first preset voltage value.

3. The driving apparatus according to claim 1, wherein the first preset voltage value is 60%-80% of a maximum value of the power supply voltage outputted by the power supply circuit.

4. The driving apparatus according to claim 1, wherein the source driver circuit is connected to a common electrode.

5. The driving apparatus according to claim 1, wherein a voltage value of the first voltage is a grounding voltage value.

6. A driving method of a display panel, comprising following steps:

inputting a turn-on signal to each gate line on the display panel at a first moment;

inputting a first voltage to each data line on the display panel at the first moment, the first voltage being a common electrode voltage of the display panel;

detecting a power supply voltage, and generating a first control signal when the power supply voltage reaches a first preset voltage value, and inputting the turn-on signal to each gate line on the display panel based on the first control signal; and detecting the power supply voltage, and inputting the first voltage to each data line on the display panel when the power supply voltage reaches the first preset voltage value, wherein the first moment is a moment when the power supply voltage reaches the first preset voltage value.

7. The driving method according to claim 6, wherein the first preset voltage value is 60%-80% of a maximum value of the power supply voltage.

8. The driving method according to claim 6, wherein a voltage value of the first voltage is a grounding voltage value.

9. A display device, comprising a display panel, and further comprising the driving apparatus of the display panel according to claim 1.

10. The driving apparatus according to claim 1, wherein the source driver circuit is connected to a common electrode.

11. The display device according to claim 9, wherein the gate driver circuit is configured to receive the first control signal, and input the turn-on signal to each gate line on the display panel based on the first control signal, the first moment being a moment when the power supply voltage reaches the first preset voltage value.

12. The display device according to claim 9, wherein the first preset voltage value is 60%-80% of a maximum value of the power supply voltage outputted by the power supply circuit.

13. The display device according to claim 9, wherein the source driver circuit is connected to a common electrode.

14. The display device according to claim 9, wherein a voltage value of the first voltage is a grounding voltage value.

* * * * *